US010759025B2

(12) United States Patent
Atwater et al.

(10) Patent No.: US 10,759,025 B2
(45) Date of Patent: Sep. 1, 2020

(54) POSITIVE INTERLOCK NETWORK (PIN) VISE AND MOLD

(71) Applicant: Millersville University of Pennsylvania, Millersville, PA (US)

(72) Inventors: Mark Andrew Atwater, Quarryville, PA (US); Andrew Ha, Lancaster, PA (US)

(73) Assignee: Millersville University of Pennsylvania, Millersville, PA (US)

( * ) Notice: Subject to any disclaimer, the term of this patent is extended or adjusted under 35 U.S.C. 154(b) by 140 days.

(21) Appl. No.: 15/974,933

(22) Filed: May 9, 2018

(65) Prior Publication Data

US 2018/0326558 A1 Nov. 15, 2018

Related U.S. Application Data

(60) Provisional application No. 62/505,464, filed on May 12, 2017.

(51) Int. Cl.
*B25B 1/10* (2006.01)
*B25B 1/24* (2006.01)

(52) U.S. Cl.
CPC ..... *B25B 1/103* (2013.01); *B25B 1/2421* (2013.01); *B25B 1/2452* (2013.01); *B25B 1/2468* (2013.01)

(58) Field of Classification Search
CPC ..... B25B 1/103; B25B 1/2421; B25B 1/2452; B25B 1/2468; B25B 1/06; B25B 1/20; B25B 1/2415; B25B 3/00; B25B 5/02; B25B 5/06; B23Q 1/035; B23Q 3/00
USPC ..... 269/257, 282, 263, 265, 266
See application file for complete search history.

(56) References Cited

U.S. PATENT DOCUMENTS

| | | | | |
|---|---|---|---|---|
| 2,754,708 | A | 7/1956 | Peterson | |
| 3,592,461 | A * | 7/1971 | Lauriti | B25B 1/2421 269/267 |
| 3,604,700 | A | 9/1971 | Gault | |
| 3,818,646 | A | 6/1974 | Peterson | |
| 3,829,077 | A | 8/1974 | Strybel | |
| 3,858,468 | A | 1/1975 | Pasbrig | |
| 3,868,102 | A | 2/1975 | Pevar | |
| 4,200,272 | A | 4/1980 | Godding | |
| 4,284,267 | A | 8/1981 | Marben | |
| 5,145,157 | A * | 9/1992 | Polk | B25B 1/241 269/210 |
| 5,988,618 | A * | 11/1999 | Meintrup | B25B 1/2421 269/266 |

(Continued)

*Primary Examiner* — Orlando E Aviles
*Assistant Examiner* — Robert F Neibaur
(74) *Attorney, Agent, or Firm* — Dinsmore & Shohl LLP

(57) ABSTRACT

A vise includes a base and two opposed jaws. At least one of the jaws is movable with respect to the other so that an object can be gripped therebetween. At least one of the two opposed jaws includes a frame and an array of polygon-shaped pins stacked parallel to one another. The frame has a bottom side and two opposed sides tapering towards the bottom side. The pins are disposed on the bottom side. Each pin has a cross-sectional shape such that when stacked together, the pins fit flush with one another and an area defined by the frame is tiled by the pins without any substantial gaps therebetween. The pins are oriented such that the tapering opposed sides direct force vectors to increase a pin-to-pin clamping force and the frame selectively clamps down on the pins such that the pins are held in place.

19 Claims, 9 Drawing Sheets

(56) References Cited

U.S. PATENT DOCUMENTS

| | | | | |
|---|---|---|---|---|
| 6,672,578 | B1 * | 1/2004 | Martens | B25B 1/2452 269/261 |
| 7,513,546 | B2 * | 4/2009 | Vranish | B25J 15/106 269/266 |
| 7,610,790 | B2 * | 11/2009 | Halford | B25B 1/2421 72/413 |
| 8,066,270 | B2 * | 11/2011 | Siegel | B25B 1/2452 269/272 |
| 8,128,077 | B2 * | 3/2012 | Halford | B23Q 1/035 269/21 |
| 2011/0291342 | A1 * | 12/2011 | Gindy | B25B 1/2421 269/266 |

* cited by examiner

FIG. 12B
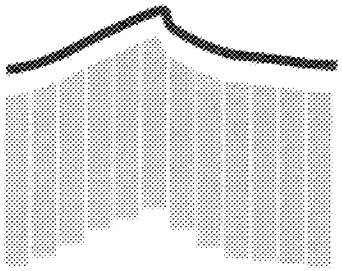
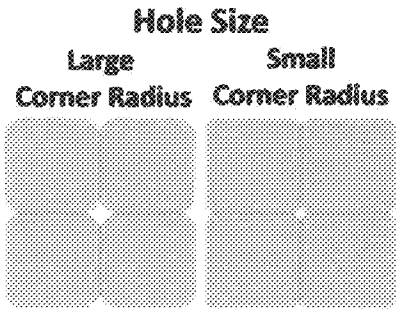
FIG. 12C
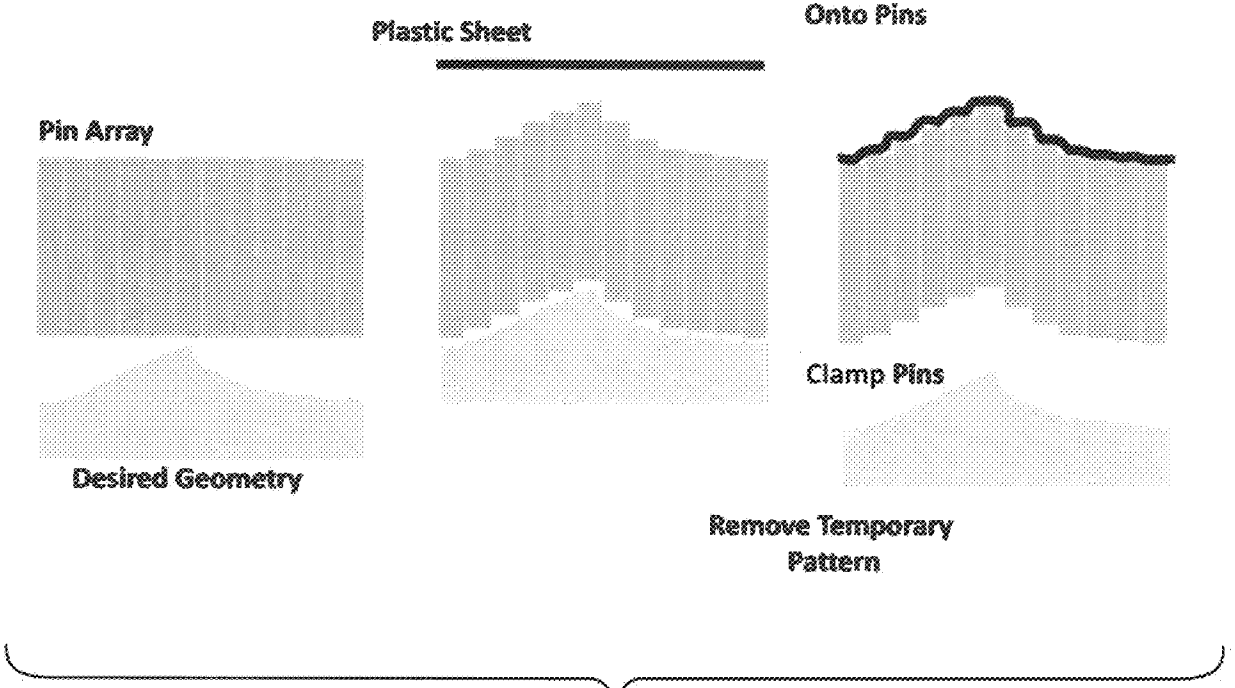
FIG. 12A

POSITIVE INTERLOCK NETWORK (PIN) VISE AND MOLD

REFERENCE TO RELATED APPLICATION

This application claims priority from U.S. Provisional Patent Application Ser. No. 62/505,464, filed May 12, 2017, the entire content of which is incorporated herein by reference.

FIELD OF THE INVENTION

The present invention relates to a device and method for holding a workpiece and, in particular, relates to an adjustable vise.

BACKGROUND OF THE INVENTION

Irregularly shaped parts are frequently encountered in cast and forged components which require finishing operations. These irregularly shaped parts present significant challenges when being held with a typical vise, as shown in FIG. 1. These irregularly shaped parts may lack symmetry or flat surfaces or must be positioned in an orientation that complicates typical workpiece holding methods. The disadvantage of standard vise jaws, shown in FIG. 1, is that flat surfaces do not provide good support for round or abnormally shaped parts. Although round parts can be accommodated through the use of accessories such as V-blocks, this does not address irregular geometries.

SUMMARY OF THE INVENTION

The present invention provides a vise for holding irregularly-shaped parts with maximum functionality and minimum complexity. Referred to as the Positive Interlock Network vise, or PIN vise, it may be characterized by the following three aspects: Positive, Interlock and Network The Positive aspect is characterized by the existence or presence of features, rather than by their absence. The positive aspect of the PIN vise of the present invention is that it fits around or even within the part to create a custom contour based on the features of the object being held.

Interlock means that two or more things engage with each other by overlapping or by the fitting of projections and recesses together. The interlock is provided by the physical barrier to movement the pins create.

The Network aspect is achieved through the connection and cooperation of the pin array which allows the object to be held securely.

The present design of the PIN vise reproduces a shape through an array of pins. In a PIN vise according to the present invention, the pins are in physical contact with each other and fit flush together, allowing the pins to be clamped from the top and held in place due to the compressive force and resulting friction created by their intimate contact.

According to an embodiment of the present invention, a vise includes a base and two opposed jaws. At least one of the jaws may be movable with respect to the other so that an object can be gripped therebetween.

The at least one of the two opposed jaws may include a frame having a bottom side and two opposed sides tapering towards the bottom side. The jaw may further include an array of polygon-shaped pins stacked in a bundle, the pins being parallel to one another and disposed on and received by the bottom side and within the frame.

Each pin may have a cross-sectional shape such that when slacked together, the pins fit flush with one another along a minimum functional distance lengthwise and an area defined by the frame is tiled by the pins without any substantial gaps therebetween.

Each pin has an inner end in cooperation for conforming to an object and gripping the object and an outer end against which the pin can be pushed. In some version, the inner end and the outer end are the same and interchangeable.

When stacked together, the pins may be oriented such that the pins form a network and the tapering opposed sides direct force vectors to increase a pin-to-pin clamping force. The pins may be in contact with one another to an extent such that each pin may assert a clamping force against its neighboring pins.

The frame may further include a top plate for clamping down on the pins such that the pins are held in place by the frame.

In some version, the other jaw may be a flat jaw.

In some version, the top plate may have a bottom surface with grooves for complementing and receiving the pins. In other versions, the top plate may have a flat bottom surface to be in contact with the flat sides of the pins.

In some version, the frame may include a bottom plate as the bottom side and a pair of angled plates forming the two angled sides, the bottom plate disposed between the pair of angled plates.

The top surface of the bottom side of the frame may be flat or with grooves for receiving the pins. The slopes of the two opposed sides of the frame are different.

In some version, the pins may each have an identical cross-sectional shape. The shape may be triangle, square or hexagon, or any other shape that can tile a plane without having any overlaps or leaving any gaps.

In some versions, the array of pins may have at least two different cross-sectional shapes. The pins within the external layer in contact with the frame may have a partial or incomplete shape of a triangle, hexagon or trapezoid, or other shapes.

In some version, the pins may have the same cross-sectional shape but some may have different sizes.

BRIEF DESCRIPTION OF THE INVENTION

FIG. 12A is a schematic showing the steps of using a PIN Mold with an array of pins to replicate a desired geometry;

FIG. 12B is a schematic showing that the pins can be finish machined to create a smooth surface; and FIG. 12C is a schematic showing that the hole size can be tailored for each application by choosing pins with appropriate corner radii.

DETAILED DESCRIPTION OF THE INVENTION

The concept of the design of a PIN vise in accordance with an embodiment of the present invention is shown in FIGS. 2-5.

Figure 5:
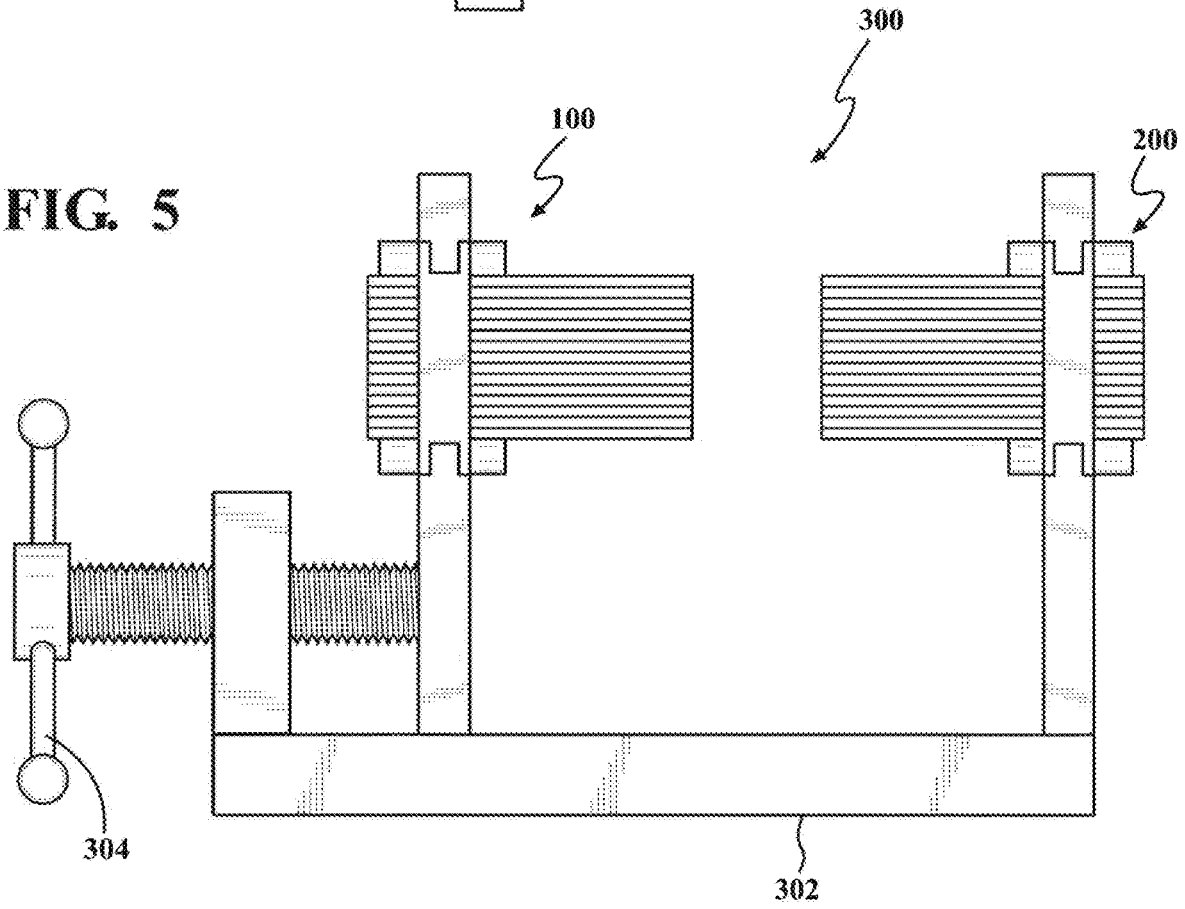
FIG. 5 is a side view of a pin vise in accordance with an embodiment of the present invention.

FIG. 5 shows an example of a pin vise 300 according to an embodiment of the present invention. The pin vise 300 may be mounted on a base 302. The vise includes two jaws 100, 200. Only one of the jaws can be moved relative to the base so that the distance between the jaws 100, 200 can be adjusted. Alternatively, both jaws may be movable. When an object is placed between two jaws, the jaw 100 is moved to approach the jaw 200, the pins will come in contact with the object and form a shape of the object. The object will be eventually clamped by the pins.

Figure 2:
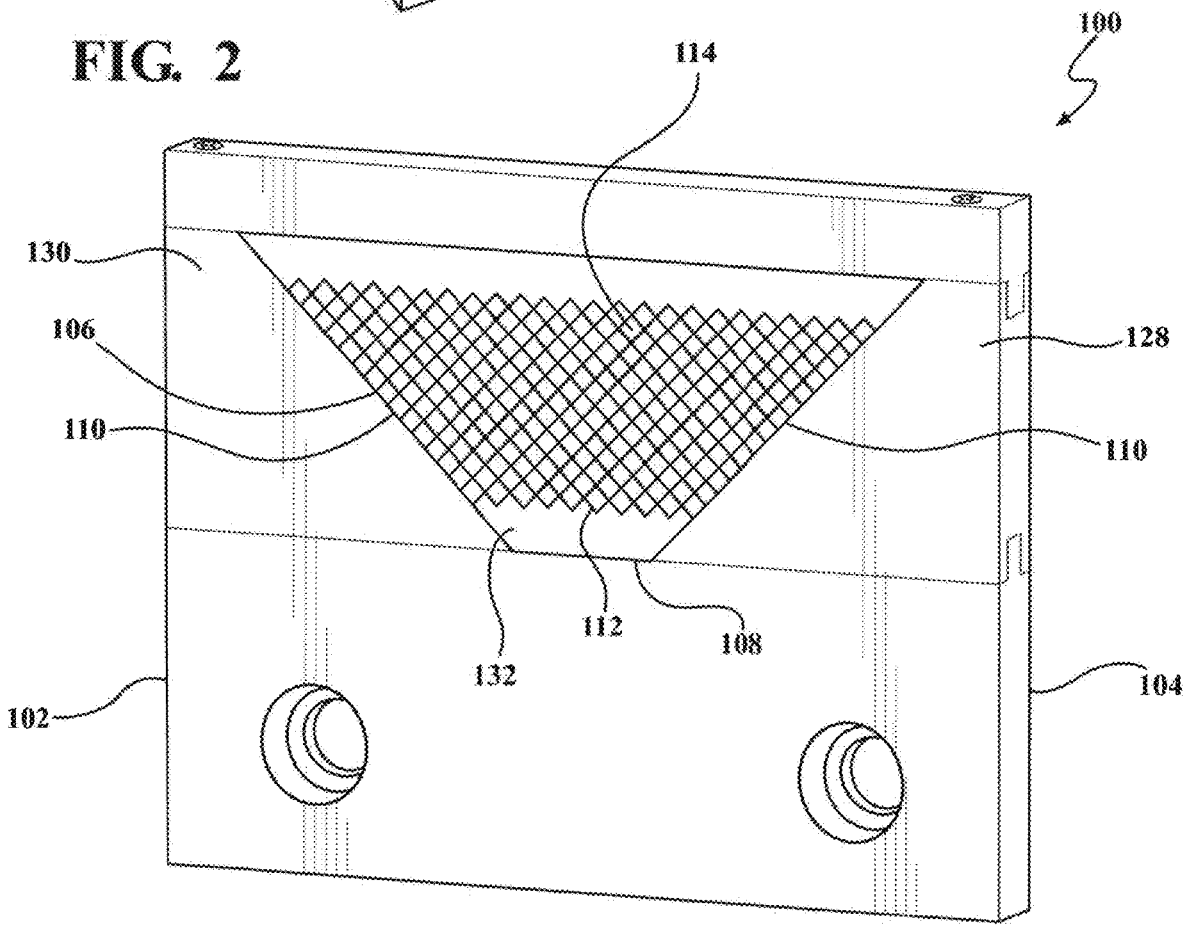
FIG. 2 is a perspective view of a jaw of a positive interlock network (PIN) vise in accordance with an embodiment of the present invention.
Figure 3:
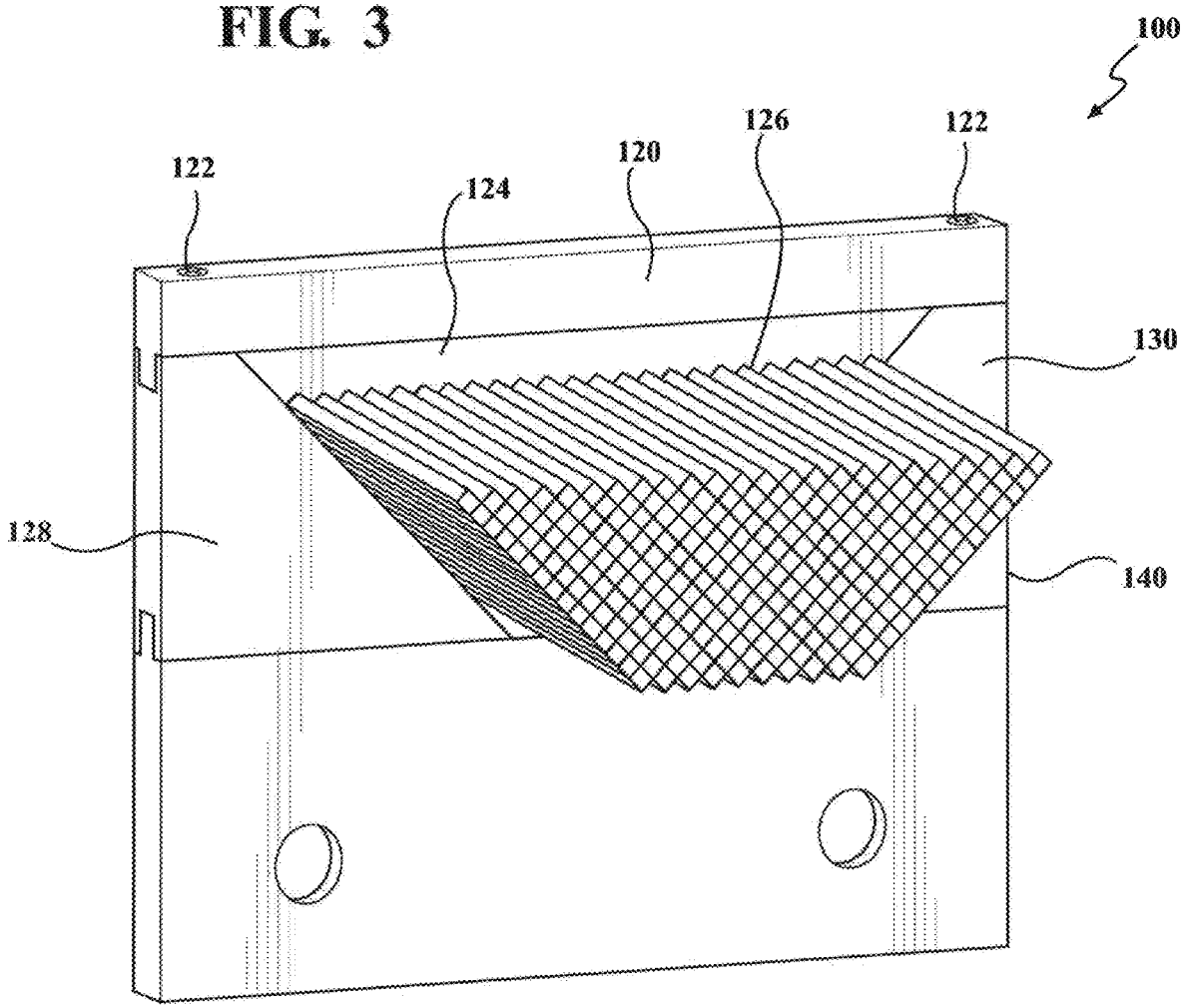
FIG. 3 is an end view of the jaw in FIG. 2.
Figure 4:
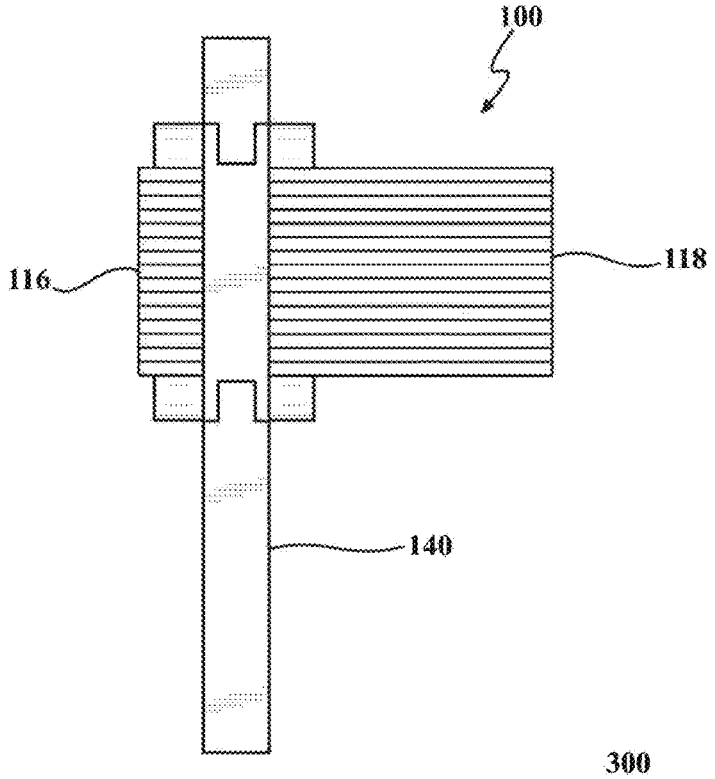
FIG. 4 is a side view of the jaw in FIG. 2.

The two jaws may be same. The jaws may also be different. For example, a vise may include a jaw with pins and a flat jaw. A vise may include two jaws with pins but the pins on one jaw may be different from the pins on the other jaw. FIGS. 2-4 show different views of one of the jaws 100 of the pin vise 300 in FIG. 5. The jaw 100 includes a frame 140 and a bundle of pins 114 clamped within the frame. The frame defines an area 106 which may take the shape of an inverted trapezoid. The frame 140 may be an integral piece including several sections. The frame may also be comprised of several pieces connected by connecting means such as screws.

In one embodiment, the frame 140 includes a bottom side 108 and two opposed sides 110, 110' tapering towards the bottom side 108. The tapered sides 110, 110' may have the same or different slopes. The bottom side may have an upper surface having grooves 112 that match the shapes of the pins for the pins to rest on.

A bundle of pins are clamped by the frame. The pins may have substantially the same cross-sectional shape. The pins may also have different cross-sectional shapes so long as when stacked together, the side surfaces of the pins are in contact with one another and there are no substantial gaps between the pins.

The pins may have the same length or different lengths. Each pin has two ends and multiple side surfaces. Two ends may be similar and not distinguishable. Each pin may have a substantially same dimension along its length. When the pins are bundled together, the pins are parallel to one another.

The frame may further include a top brace placed on the top of the pins. The top brace may be tightened by threading members such as screws. The top brace works in corporation with the opposed tapering sides and the bottom side for clamping down the pins such that the pins are held in place.

When the pins are clamped in place within the frame, one end may be called an outer end. The end for gripping the object may be called an inner end.

The slope of the tapering sides of the frame may be selected according to the shape of the pins and the orientation of the pins. In one example, the pins are oriented such that each side of the pin is pushing against a side surface of another pin or the frame. There will be no side which is oriented vertically. In other words, all sides of the pins are oriented at an angle with respect to a vertical axis.

Figure 9A:
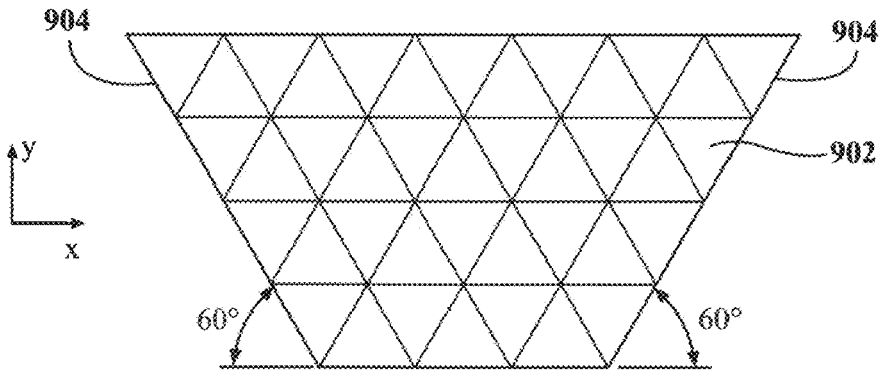
FIG. 9A is a schematic showing detail of the pins having a shape of a triangle.
Figure 9B:
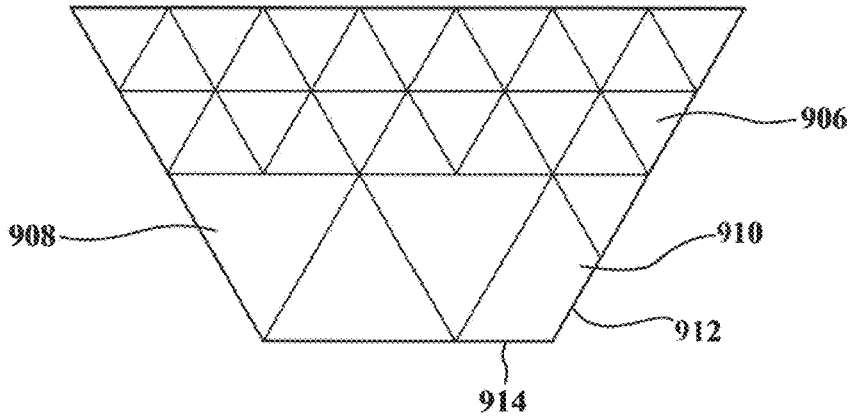
FIG. 9B is a schematic showing detail of the pins having a shape of a triangle with varying sizes.
Figure 9C:
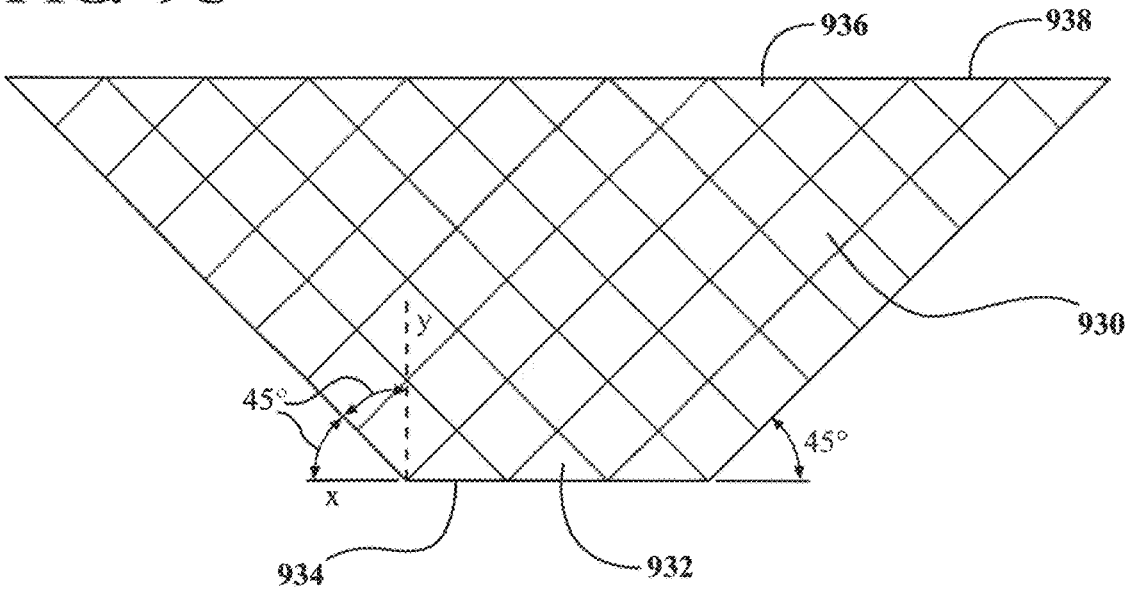
FIG. 9C is a schematic showing detail of the pins having a shape of a square oriented at a 45-degree angle with respect to a horizontal axis.

In one embodiment, as shown in FIG. 9C, the pins are square pins which are oriented such that each side of the pins is at a 45 degree angle with respect to a vertical axis. The slope of the tapering sides of the frame is also selected to be 45 degrees with respect to either the horizontal axis x or the vertical axis y in order to be aligned with the sides of the pins. At the bottom, half-triangle shaped pins 932 can be utilized so that the bottom side 934 is flat without any grooves. Likewise, half-triangle shaped pins 936 can be used at the top so that the top side 938 is flat without any grooves.

There are two principal forces to assess: 1) the clamping force which retains the pins in a desired position (Pin Clamping Force), and 2) the damping force of the vise on the part to be held (Vise Clamping Force). The pin clamping force is determined by the force applied to the top brace, achieved by simple screw force for example, and the vise clamping force is applied using a vise handle, seen in FIG. 5.

Figure 1:
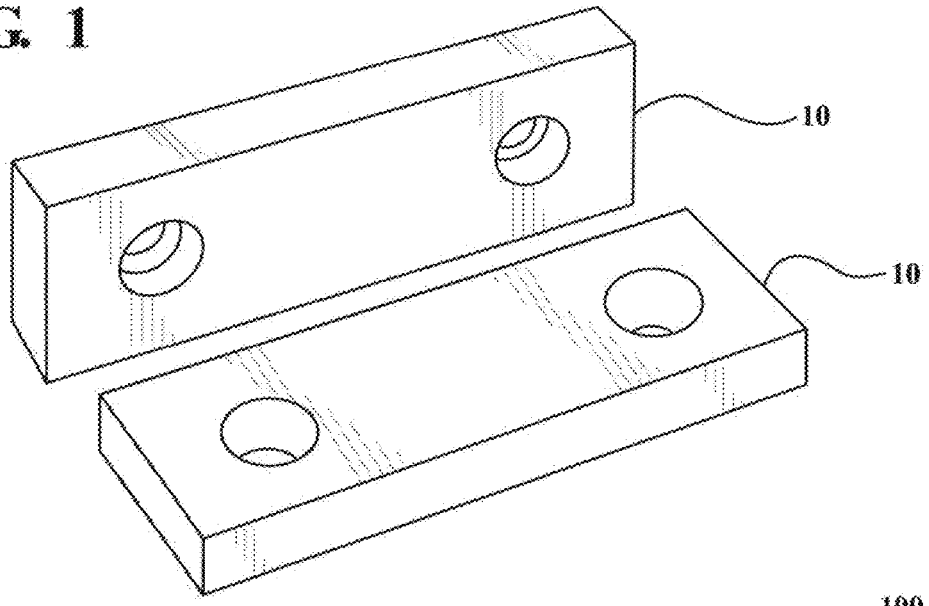
FIG. 1 is a perspective view of flat jaws of a common vise.

The jaw may include a mounting plate 104. The mounting plate 104 is similar to a flat jaw 10 of a common vise shown in FIG. 1. In one example, the mounting plate 104 is connected to the base by threaded members. Although no new vise must be purchased, a dedicated vise body could be used for more critical applications where greater rigidity is needed. As an add-on to existing standard flat vises, the benefit of a vise in the present invention is the easy incorporation into any current machine shop or production facility.

In another embodiment, the vise is comprised of a number of independent members. A pair of angled plates 128, 130 resting on the mounting plate 104, along with the mounting plate, form a tapered frame in which an array of pins 114 are held. Directly on the top of the mounting plate and between the pair of angle plates is a fixed plate 132, the surface of which is designed with grooves 112 that match and receive the shape of the pins. Likewise, an adjustable insert plate 124 is designed with a surface having grooves 126 that mate to and receive the shape of the pins to be disposed between the array of pins and a top brace 120.

The adjustable insert plate 124 is not rigidly held, but rather it rests on top of the pins. It can be clamped down by simple screw force or by any other standard means such as cam-action, toggle or hydraulic clamping. The top brace 120 may be clamped by a two-point clamping using two threaded members or by a three-point clamping using three threaded members. The top brace 120 may also be clamped by a uniform clamping by a toggle. The adjustable insert plate 124 may be made from materials with high hardness, such as brass or steel, for the benefit of its rigidity.

Figure 6:
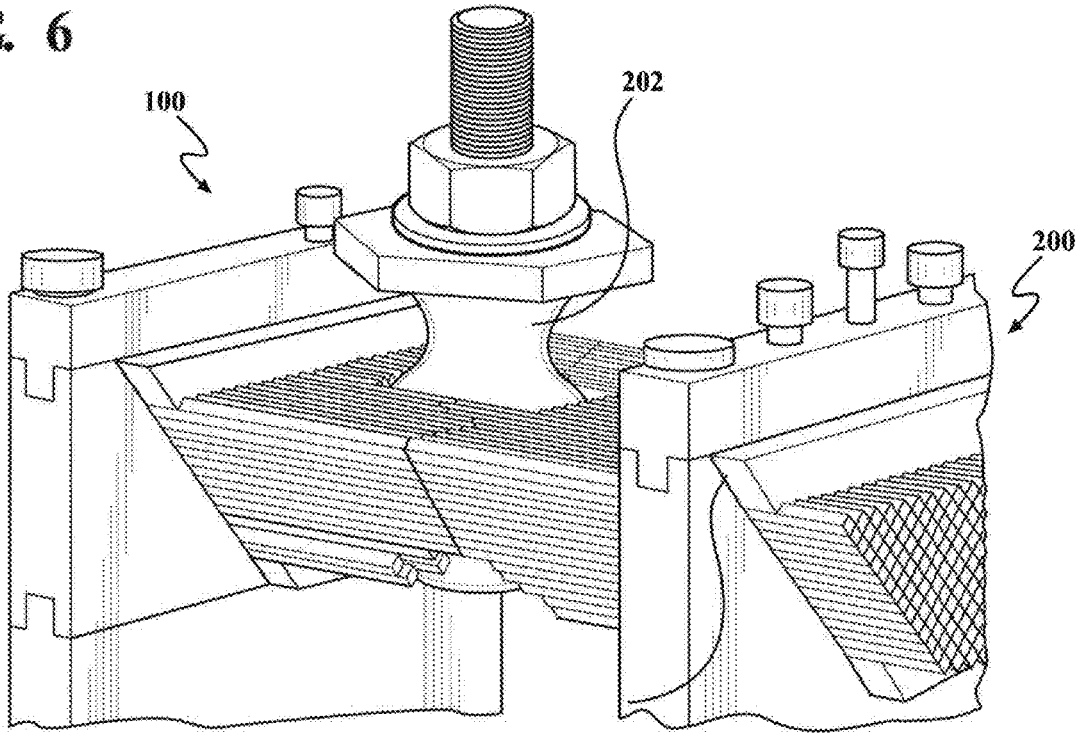
FIG. 6 is a perspective view showing basic clamping on a hitch ball using a PIN vise in accordance with the present invention.
Figure 7:
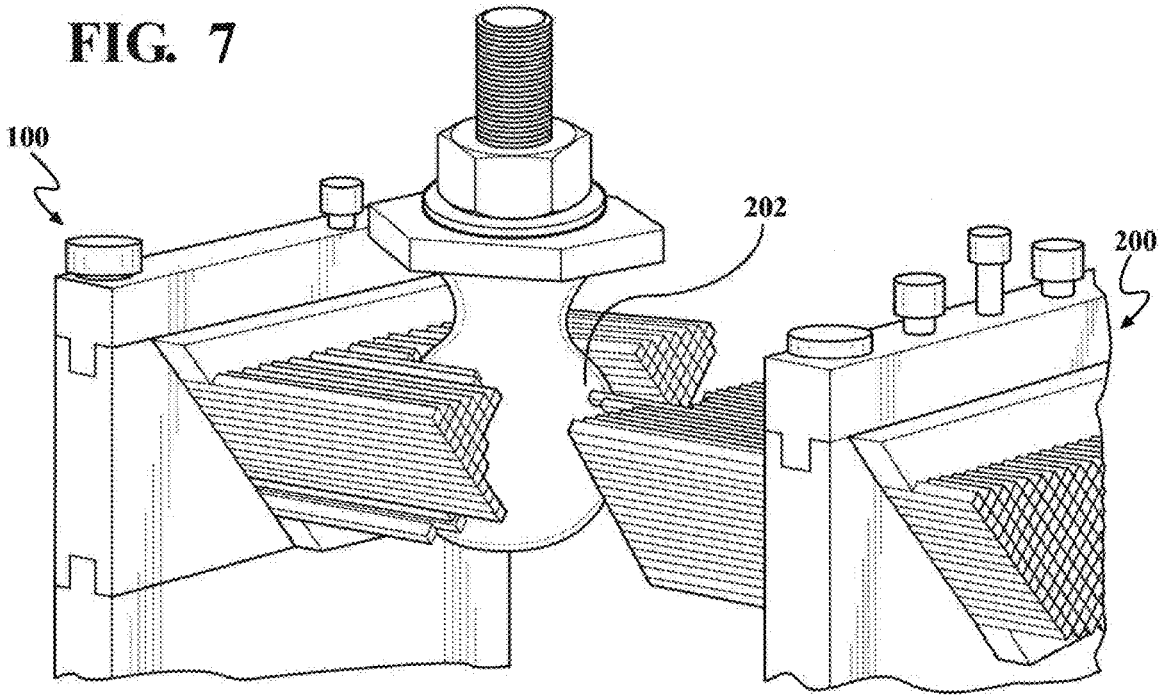
FIG. 7 is a perspective view of a PIN vise showing that the hitch ball in FIG. 6 is held in place even after unclamping.

To set the vise, an object is placed between two jaws. In the example shown in FIG. 6, the object is a round ball 202. This example was chosen to exemplify a contoured surface. In an ideal circumstance, both sides of the jaw would be engaged. The outer ends of the pins from both of the jaws are pushed by hand towards the object until all the pins fit around the object and the object is surrounded to the level desired. Once this is achieved, the pins are locked into position. One of the jaws can be moved along the track by rotating the vise handle. As the jaw is retracted, the object is continued to be held by the other jaw, as shown in FIG. 7. If the part design changes slightly or significantly, the process can be easily repeated to reset the shape. The vise of the present invention can eliminate the need of casting a jaw. This saves time and money.

Figure 8:
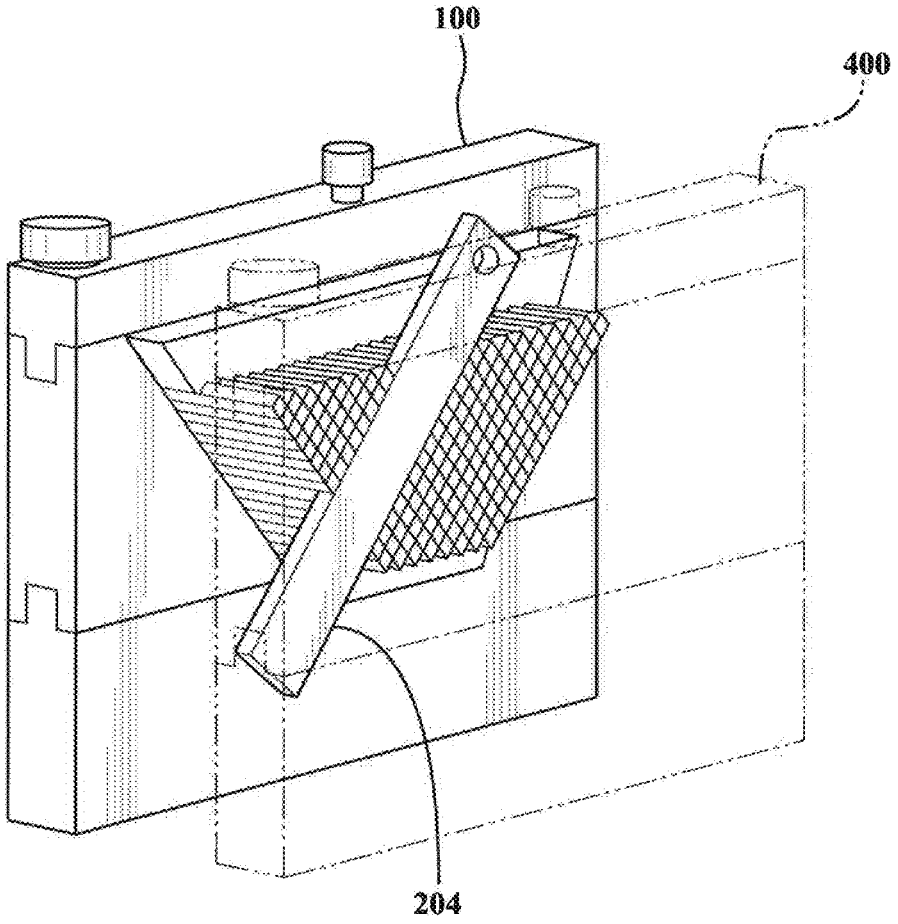
FIG. 8 is a perspective view of a PIN vise showing that an object can be held at a predetermined angle such as 45 degrees as shown.

The geometry of the pins can act as a locating surface for elevating a part or holding flat parts at a particular angle, e.g., a 45 degree angle using the square pins, as shown in FIG. 8. In an existing standard vise with flat jaws, an object is often likely to be slipping when the clamp is being tightened. The vise of the present invention can also be used to prevent the object from slipping and rotating relative to the vertical axis.

One of the jaws may be flat 400, working together with a pin vise jaw 100, as shown in FIG. 8.

Many variations may be applied to the design. Instead of using square pins, other shapes may be used. The shapes of the pins may be triangle, square, rectangle, hexagon, or any shape that can tile a plane without having any overlaps or leaving any appreciable or substantial gaps. The size of the pins can be varied to produce "high-definition" workpiece holding. The pin material can be readily changed to a softer type for delicate workpieces. The length of the pins can be adjusted as well.

FIGS. 9A-9F illustrate several examples of various shapes of the pins. Note that the side edges in some cases are a cut plane and not representing the entire array. FIG. 9A shows an array of triangle-shaped pins. The pins are oriented such that each triangle is symmetric with respect to the vertical axis y. The slope of the sides 904 of the frame is selected to be at 30 degrees relative to the vertical axis so that the sides of the frame are aligned with one side of the pins. FIG. 9B shows an array of triangle-shaped pins having two different sizes 906 and 908. The pins having larger sizes 908 may be arranged at the bottom to provide more support for smaller pins on the top. The pins on the external layer 901 may have an incomplete shape to accommodate the shape of the boundary.

Figure 9D:
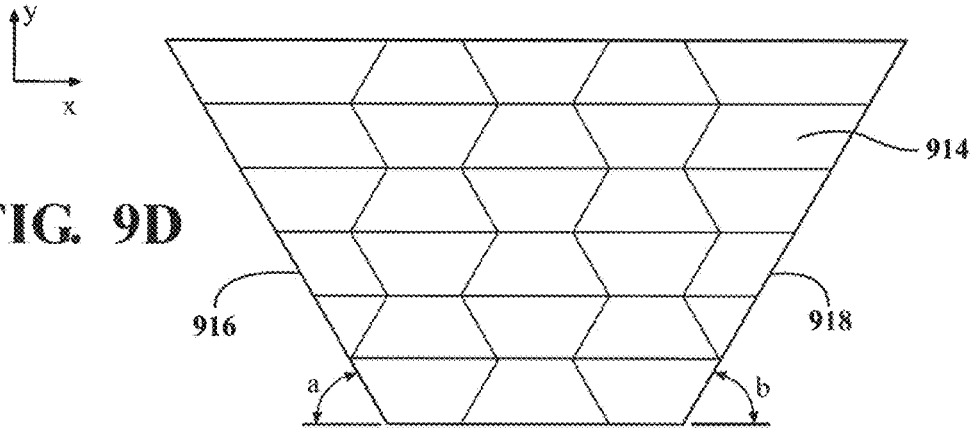
FIG. 9D is a schematic showing detail of the pins having various trapezoidal shapes and that the slopes of two sides of the frame may be different.

FIG. 9D shows an array of the pins having various non-identical trapezoid shapes 914. The slopes of two sides 916, 918 may be different, as the angles a and b might be different to accommodate different shapes of the pins.

Figure 9E:
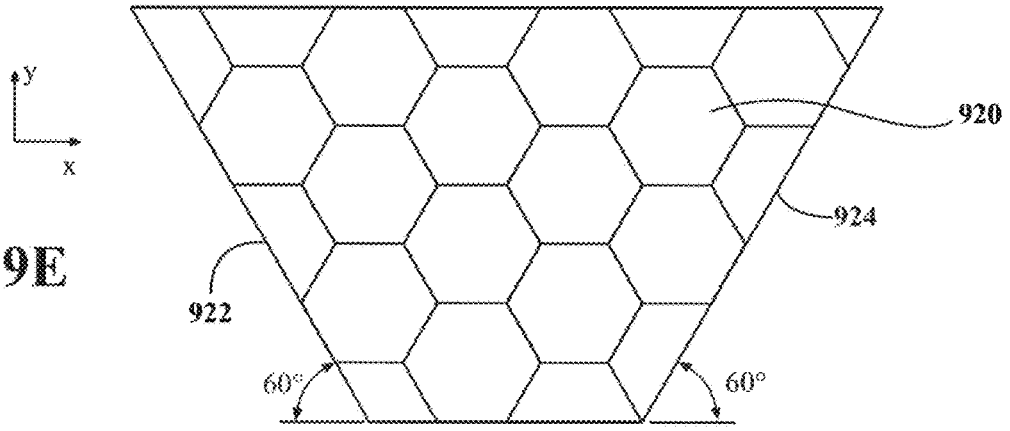
FIG. 9E is a schematic showing detail of the pins having a shape of a hexagon.

FIG. 9E shows an array of hexagon-shaped pins 920. The pins are oriented such that each hexagon is symmetric with respect to the vertical axis y and one side of the hexagon is aligned with the horizontal axis x. The slope of the sides of the frame is selected to be at 60 degrees relative to the horizontal axis x so that the sides 922, 924 of the frame are aligned with the pins.

Figure 9F:
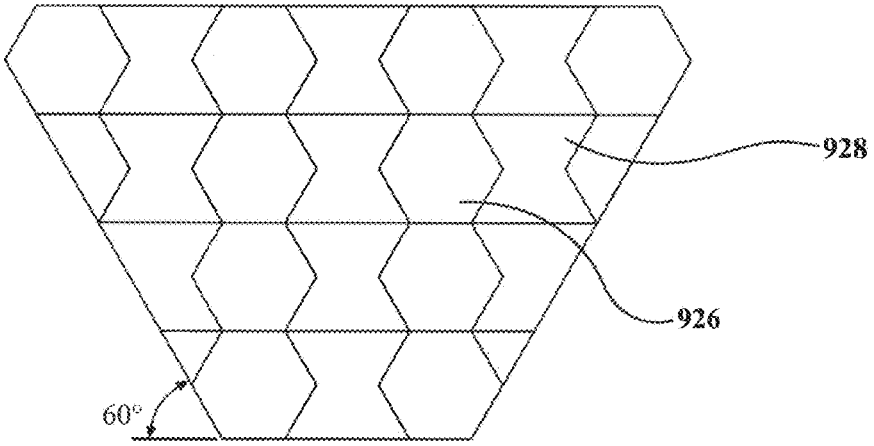
FIG. 9F is a schematic showing detail of the pins having a shape of a hexagon and an hourglass.

FIG. 9F shows an array of pins having either a hexagon shape 926 or an hourglass shape 928 complementing one another, leaving no gap or overlap within the area within the frame.

The presently disclosed design makes exchange of the pins extremely simple, and the exchange can be done within minutes to reset the pin array. With the addition of a simple setup jig, that time could be reduced greatly.

Figure 10:
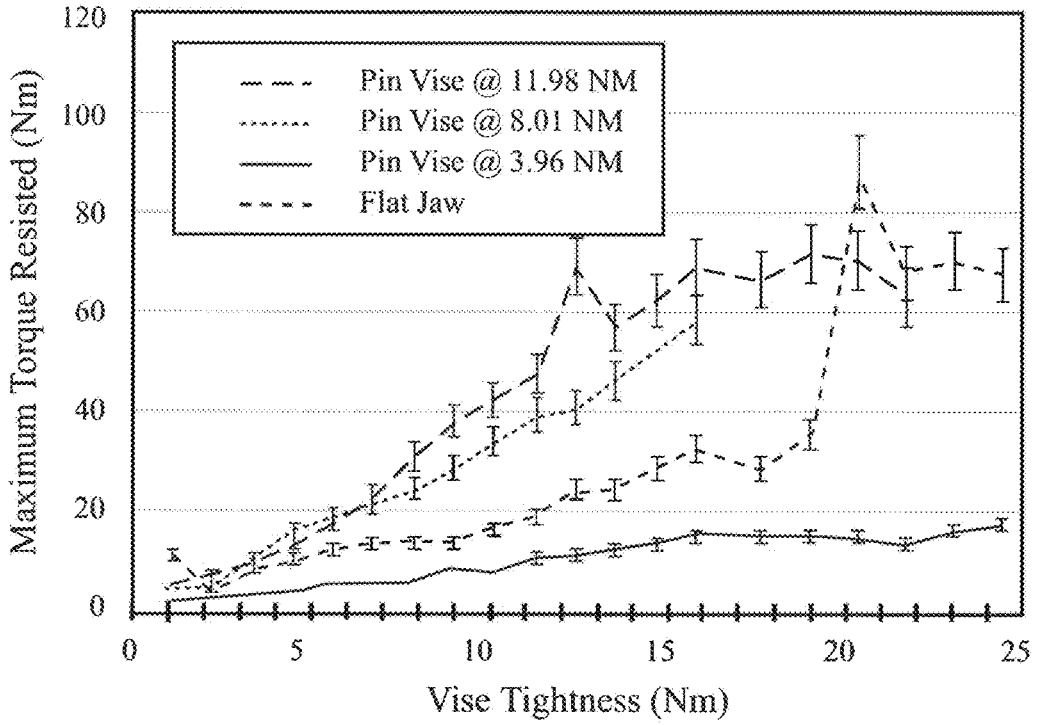
FIG. 10 is a graph showing that the PIN vise in FIG. 5 provides a higher resistance to rotation.
Figure 11:
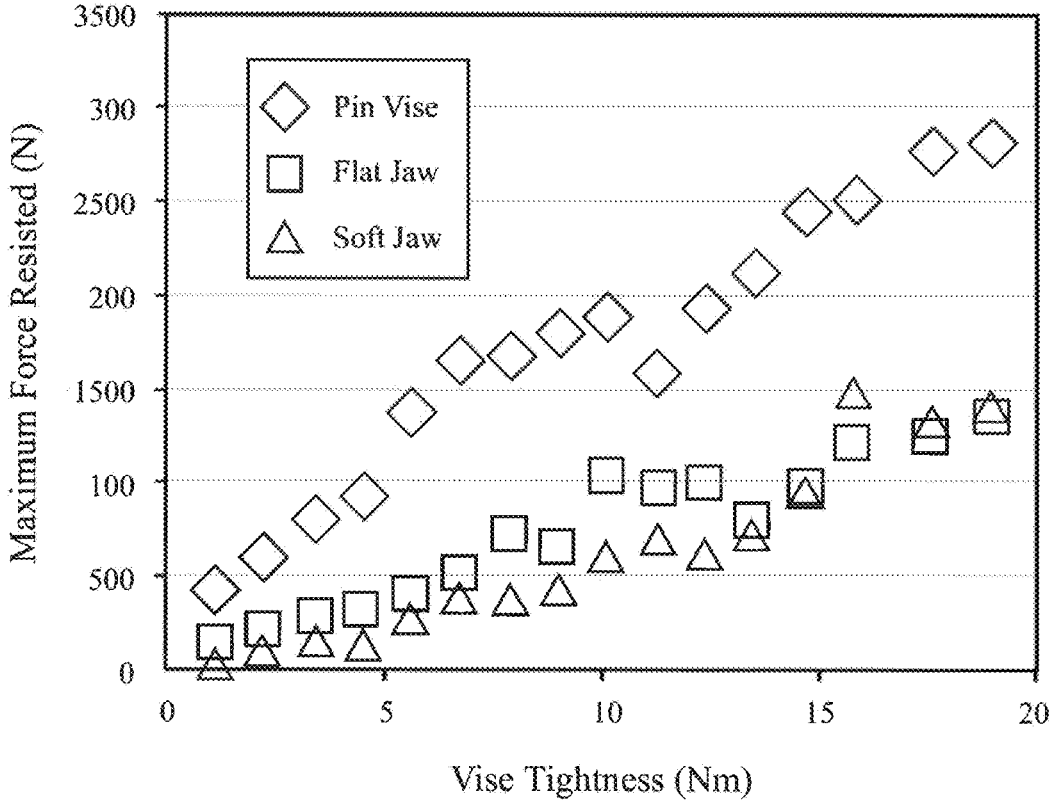
FIG. 11 is a graph showing that the PIN vise in FIG. 5 provides a higher resistance to sliding.

The PIN vise was found to be more resistant to an applied torque on a spherical part than flat jaws or the more commonly used V-blocks. As shown in FIG. 10, the flat jaws only exceed the PIN vise at high clamping pressures where the ball surface was physically deformed to create a flat spot. By increasing the pin clamping force so that higher vise clamping force can be used, it is expected that the benefit can be extended. In addition to the torque resistance, translation was also tested using a load frame to measure force and displacement simultaneously, as shown in FIG. 11. In these tests, the PIN vise has been found to exhibit higher retaining force than standard flat jaws, and the only limit reached is the rigidity of the vise jaws, not actual slipping of the ball gripped by the pins. That is, the jaws were found to flex before the ball slips. Additional testing identified that it is not the pins that flex, but the entire assembly, and reversal of the applied force elastically restores the original position. The top brace can be of increased cross-sectional area to resist bending, and the whole assembly can be thicker such that the design can be more robust.

Many possibilities of applications of the present invention exist outside of workpiece holding in manufacturing. This basic design can be applied in any industry that requires complex surfaces which change on a regular or semi-regular basis. For example, the technology could be modified and advanced for use in applications such as vacuum forming or molding for packaging in shipping, where the product to be shipped is used to create a positive mold and the pins are retained in the shape by clamping. Large companies in the thermoforming industry are actively engaged in research to develop technology to eliminate the need for back drilling. Some have attempted to use nano-foamed metals instead of traditional castings as the starting block for the mold piece. The holes are too small, however, and clog too quickly at the molecular level as the device is used, even in clean rooms. Alternatively, 3D printing is capable of complex geometries, but it is limited and/or costly for production operations.

The disclosed design has been demonstrated to allow for fine detail replication, and that without any refinement for the purpose. Indeed, the very same prototype, which was used to hold objects, was also used in vacuum forming for proof-of-concept. The greatest drawback is that highly smooth objects cannot be created as with machined molds. Although it is potentially viable that the pins may be machined and still provide some benefit by the reduction in hole drilling, non-critical surface detail may not require such processing.

For example, when shipping items, the appearance and detail replication is not of first-importance. Function is the primary necessity. Competitor products in the packing industry include enclosed-bag foam, bubble wrap, brown paper wadding, air packs, Styrofoam peanuts, and biodegradable peanuts. These items have a similar function of filling volume rather than directly forming to the product(s). If a customizable form could be created to shape sheet plastic to any desired geometry, the space requirement for storage and the commensurate waste would be greatly reduced.

FIG. 12 illustrates an example of the operation of a PIN mold. The operation of the PIN Mold requires a desired geometry which is placed against pins to move them relative to each other. Once the pins are moved, they are clamped in place to hold the shape. The molded shape can be used on either side to create a negative or positive mold. The plastic sheet is heated and formed to the molded pins creating a rough replication of the shape, as shown in FIG. 12A. In cases that require a smoother surface, the pins can be finish machined, as shown in FIG. 12B. The hole size determines the flow of air and can be chosen based on pin geometry, as shown in FIG. 12.

As will be clear to those of skill in the art, the embodiments of the present invention illustrated and discussed herein may be altered in various ways without departing from the scope or teaching of the present invention. Also, elements and aspects of one embodiment may be combined with elements and aspects of another embodiment. It is the following claims, including all equivalents, which define the scope of the invention.

The invention claimed is:

1. A vise, comprising:

a base;

two opposed jaws, at least one of the jaws being movable with respect to the other so that an object can he gripped therebetween, at least one of the two opposed jaws including a frame and having a jaw face, each jaw face having a front face and including an array of polygon-shaped pins stacked in a bundle, the pins parallel to one another, and surrounding pins are flush with one another, and disposed within the frame;

each pin having an inner end forming the front face for conforming to an object and gripping the object;

wherein said frame further comprises a means configured to direct force vectors to vary a pin-to-pin clamping force;

and the frame selectively clamping down on the pins such that the pins are held in place.

2. The vise of claim 1, wherein the other of the jaws is a flat jaw.

3. The vise of claim 1, wherein the means includes a bottom plate as the bottom side and a pair of angled plates forming the two angled sides, the bottom plate disposed between the pair of angled plates.

4. The vise of claim 3, wherein the bottom plate has a top surface with grooves for receiving the pins.

5. The vise of claim 1, wherein slopes of the two opposed sides of the frame are different.

6. The vise of claim 1, wherein each pin has an identical cross-sectional shape.

7. The vise of claim 1, wherein each pin has a triangular, square or hexagonal cross-sectional shape.

8. The vise of claim 1, wherein the pins in the array have at least two different cross-sectional shapes.

9. The vise of claim 1, wherein the pins in the array have a partial or incomplete shape of a triangle, hexagon or trapezoid.

10. The vise of claim 1, wherein the pins in the array all have the same cross-sectional shape but at least some of the pins have different sizes.

11. The vise of claim 1, wherein the pins all have the same length.

12. The vise of claim 1, wherein the other of the jaws includes a frame and an array of pins held in place within the frame.

13. The vise of claim 12, wherein the pins in each jaw are the same.

14. The vise of claim 1, wherein the means includes a bottom side and two opposed sides tapering towards the bottom side.

15. The vise of claim 14, wherein the means further comprises a top plate having a bottom surface with grooves for complementing and receiving the pins, the top plate selectively clamping down on the pins for applying a clamping force on the pins.

16. The vise of claim 1, wherein the pins are configured to fit flush with one another when stacked together and an area defined by the frame is tiled by the pins without any gaps therebetween.

17. A jaw, for a vise of the type having two opposed jaws, the jaw comprising:

a frame; and a jaw face having a front face and including an array of polygon-shaped pins stacked in a bundle, the pins parallel to one another, and surrounding pins are flush with one another, and disposed within the frame;

each pin having an inner end forming the front face for conforming to an object and gripping the object;

wherein said frame further comprises a means configured to direct force vectors to vary a pin-to-pin damping force;

and the frame selectively clamping down on the pins such that the pins are held in place.

18. The jaw of claim 17, wherein the means includes a bottom side and two opposed sides tapering towards the bottom side.

19. The jaw of claim 17, wherein the pins are configured to fit flush with one another when stacked together and an area defined by the frame is tiled by the pins without any gaps therebetween.

* * * * *